United States Patent [19]

Warshaw et al.

[11] 4,238,270

[45] Dec. 9, 1980

[54] TAPE PRESSING ROLLER SET APPLYING DIFFERENT WIPE DOWN PRESSURES

[75] Inventors: Saul Warshaw, Hawley, Pa.; Winton S. Loveland, Fort Salonga, N.Y.

[73] Assignee: The Loveshaw Corporation, Deer Park, N.Y.

[21] Appl. No.: 963,406

[22] Filed: Nov. 24, 1978

[51] Int. Cl.[3] ..... B31F 1/00

[52] U.S. Cl. ..... 156/468; 156/489

[58] Field of Search ..... 156/486, 489–491, 156/468; 53/137

[56] References Cited

U.S. PATENT DOCUMENTS

| | | | |
|---|---|---|---|
| 2,834,168 | 5/1958 | Lopez | 53/137 |
| 3,461,020 | 8/1969 | Loveland et al. | 156/489 X |
| 4,039,367 | 8/1977 | Warshaw et al. | 156/486 |

FOREIGN PATENT DOCUMENTS 2127965 12/1972 Fed. Rep. of Germany .

*Primary Examiner*—David A. Simmons

*Attorney, Agent, or Firm*—Watson, Leavenworth, Kelton & Taggart

[57] ABSTRACT

A pair of wipe down rollers are carried on a respective pair of rotatable arms to which arms force can be applied through separate air actuated cylinders so as to provide that the wipe down roller which engages in wipe down contact with the trailing vertical edge of a carton being sealed with tape applies a higher magnitude of positive wipe down pressure to such trailing vertical edge, than is applied by the wipe down roller which engages the carton leading vertical edge.

9 Claims, 4 Drawing Figures

TAPE PRESSING ROLLER SET APPLYING DIFFERENT WIPE DOWN PRESSURES

BACKGROUND OF THE INVENTION

Various types of apparatus are known for use in applying sealing tape to cartons. Such apparatus generally includes tape wipe down means which can be provided as a rotary roll means, a shaped wipe down shoe or a like device for pressing the tape against the vertical and horizontal surfaces of the carton, that is, along the meeting line of the foldable flaps defining the horizontal (and in some forms the end surfaces as well where such end surfaces are formed from foldable flaps) of the carton, the tape generally running along a sealing course extending appreciably along both the horizontal and vertical end surfaces of the carton. Representative of tape wipe down roller means are those, for example, disclosed in commonly assigned U.S. Pat. Nos. 3,236,716 and 3,461,020. While the tape wipe down devices described in such patents are satisfactory for their intended purpose, there are certain instances where it is desirable that substantially greater wipe down pressure be applied to the carton surfaces particularly in respect of the wiping down of the tape along a trailing vertical carton surface, since the carton is generally moving in a direction away from the applied wipe down force and it is desired that the tape adhesive at the rear be such as to obviate its tearing loose with subsequent carton handling operations. In some situations it is possible due to the travelling speed of the carton, that insufficient wipe down pressure be applied and hence the tape on such trailing vertical surface may not be securely sealed thereto in the intended manner. The degree to which successful adhesion of the tape is achieved is a function of the applied wipe down pressure applied thereto. In a device of the type disclosed in U.S. Pat. No. 3,236,716 a greater wipe down force is applied by the wipe down means associated with arm 52, e.g., than with arm 53. Hence the tape at the front vertical surface 42 of a carton generally is more securely adhered than that wiped down on the carton rear surface 46 by the roller carried on arm 53. If it is desired to increase the wipe down pressure applied by arm 53, this can be done but it results in a greater wipe down pressure being applied by arm 52 and while thus the desired wiping down of tape at the rear of the carton can be achieved, such procedure can result in crushing the front of the carton.

SUMMARY OF THE PRESENT INVENTION

The present invention relates to apparatus for applying adhesive tape along at least portions of the horizontal and vertical surfaces of a carton travelling on a horizontal conveyor. The purpose and intent of the invention is to provide such a device as applies a greater degree of pressure during wipe down of the trailing vertical surface of the carton than has been generally available with devices heretofore used for the same purpose and a wipe down pressure greater than is applied at the front vertical surface of the carton. In a practical embodiment, the invention conveniently is employed as an improvement in a carton sealing machine of the type and general construction described in commonly owned U.S. Pat. No. 4,028,865.

In accordance with the invention, the apparatus comprises a cooperative pair of first and second arms swingably mounted for rotation about co-directionally disposed axes, such mounting being in the same fashion as is employed in the wipe down roller units described in the aforementioned patents. Each arm, as in fashion similar to those described in said mentioned patents carries at its free end, tape wipe down means, e.g., a rotary roller, shoe or the like, and the swinging arms have an initial carton engaging position in which they are closed together in scissor fashion and present one of the rotary roll means for engagement with a carton leading vertical surface and the other rotary roll means for engagement with a carton horizontal surface, there having been applied intermediate the wipe down roll means and the carton a length of tape. For example, the said one roll will initially engage the front vertical wall of the carton and the other will engage at either the bottom or the top wall of the carton with tape sandwiched therebetween depending on whether the pair of arms is a lower set or an upper set, i.e., is intended for wipe down at the top or bottom of the carton of the tape sealing station. With horizontal movement of the carton following initial engagement with the rotary roll means, the arms, e.g., the lower set carrying such means are opened or spread apart and maintain the one roll initially in contact with the leading vertical surface of the carton and such roll moves up the leading vertical surface a distance and then moves back down said leading vertical surface passing to the underside or bottom surface of the carton applying wipe down pressure of certain magnitude to the tape. At the same time, the second rotary roll has its initial contact along the bottom horizontal surface of the carton and then upon appropriate passage of the carton along the horizontal conveyor on which the carton is travelling, said second rotary roll means moves up the rear or trailing vertical surface of the carton and applies wiping down pressure to tape along such surface with the second rotary roll means subsequently rolling back down said trailing vertical surface and out of engagement therewith. Upon complete passage of the carton beyond the wipe down roll means, means are employed to return the two arms to the initial carton engaging position.

The present invention provides that separate force applying means are operatively connected to the respective two arms so that while the contact of the carton front vertical surface with the first wipe down roll will rotate its associated arm against a face tending to resist such rotation and hence apply a wipe down pressure to the tape of predetermined magnitude, a greater magnitude of force can be applied to the second roll which wipes down the tape at the carton rear vertical surface. The separate force applying means functioning to apply to the arm carrying the one rotary roll means, applies thereto a force tending to rotate such arm in a direction counter to the rotation which has been imparted to such arm by the movement of the carton through the taping station. On the other hand, the force applying means associated with the arm carrying the second rotary roll means applies such force as tends to rotate the arm in the direction of the travel of the carton.

In preferred form, the separate force applying means are constituted by fluid actuated cylinder units and most desirably by means of pneumatically actuated cylinder units. Each cylinder unit includes a cylinder rod and the rod in turn is connected with a chain member with the chain being wound about sprocket members fixed to the respective arms. When the pair of arms are in their initial carton engaging position, the cylinder unit associated with the arm carrying the said one roll is in a retracted position and the rod associated with the arm carrying the second roll is in an extended position. However, upon engagement of the carton with the respective roll means, the movement of the carton causes the arm carrying the first roll to rotate with such rotation being effective to cause extension of the rod of the cylinder unit associated therewith and in opposition to any fluid pressure present in such cylinder unit. In other words, the cylinder rod which has been in retracted position caused by the presence of fluid pressure acting on the cylinder piston is caused to extend notwithstanding the presence of air pressure therein. At the same time the rod of the cylinder unit associated with the second arm and which rod was in extended position will remain so until the carton has moved a predetermined distance along the horizontal conveyor, e.g., until a location immediately adjacent that at which the second roll means will pass from the underside of the carton to engagement with the trailing vertical surface. At such point, air under pressure is admitted to the cylinder and acts on the extended rod to cause same to retract and as a result, apply a rotating force to the arm in the direction in which the carton is moving and hence an optimized and higher magnitude of wipe down pressure by the second wipe down roll than is applied by the first roll.

In preferred form, the air pressurized fluid or air flow admitted to the cylinder units associated with the second roll is of greater magnitude than that admitted to the cylinder unit associated with the arm carrying the first roll member and hence pistons of substantially the same diameter are used in the respective cylinders. For example, the air pressure supplied to such cylinder unit could be on the order of forty pounds per square inch gauge pressure, whereas, that supplied to the first cylinder unit could be considerably less, being for example on the order of 20 psig so that the ratio would be at least 2:1.

BRIEF DESCRIPTION OF THE DRAWINGS

The invention will appear more clearly from the following detailed description taken in conjunction with the accompanying drawings in which.

Throughout the following description, like reference numerals are used to denote like parts in the drawings.

DESCRIPTION OF THE PREFERRED EMBODIMENTS

Figure 1:
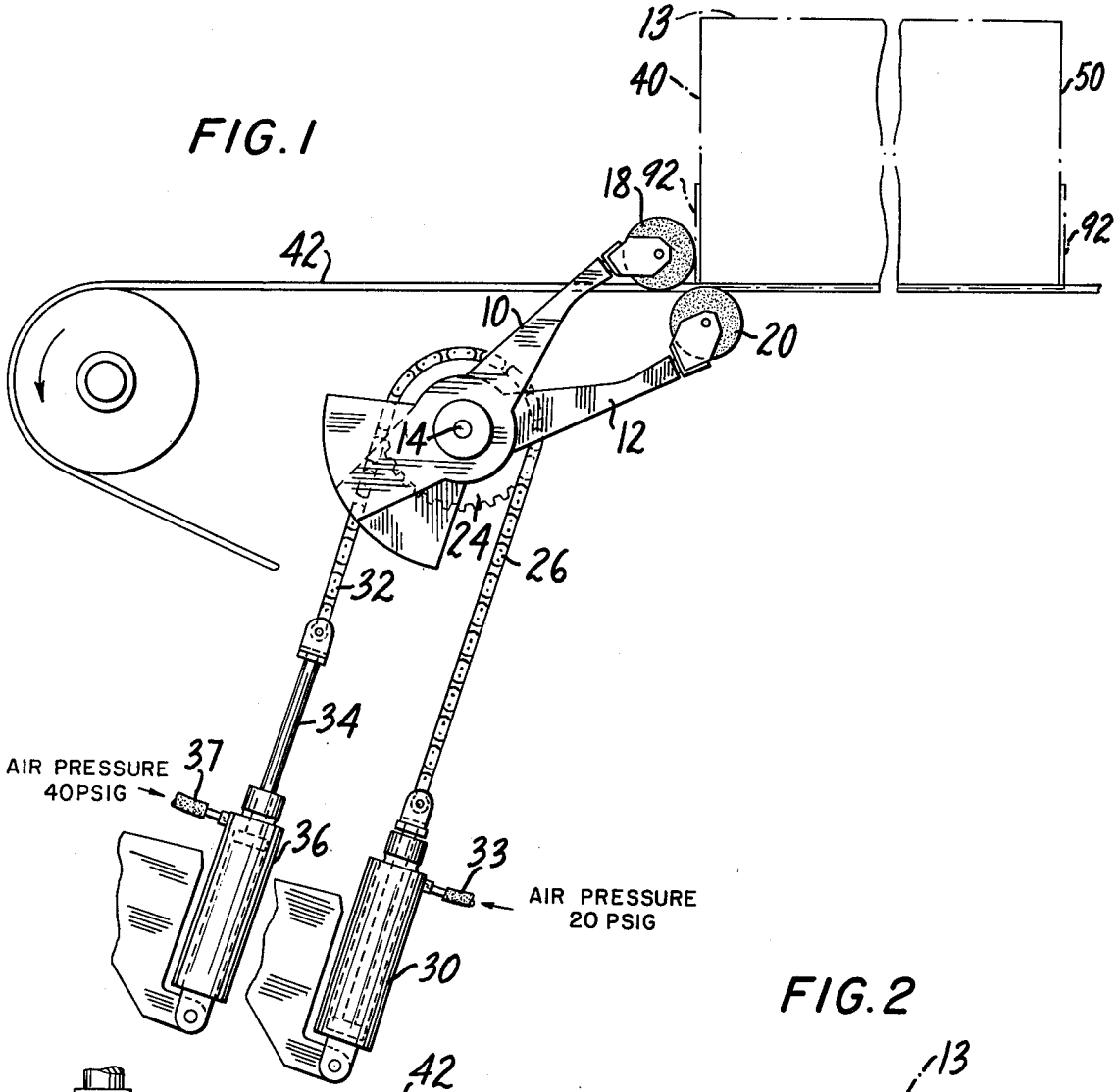
FIG. 1 is a side elevational view of apparatus made in accordance with the present invention, the pair of arms carrying the wipe means being shown in an initial carton engaging position, the respective cylinder units associated with the said arms being shown in the positions wherein that associated with the first wipe down roll has its rod in retracted position while that associated with the second wipe down roll has its rod in extended position.
Figure 2:
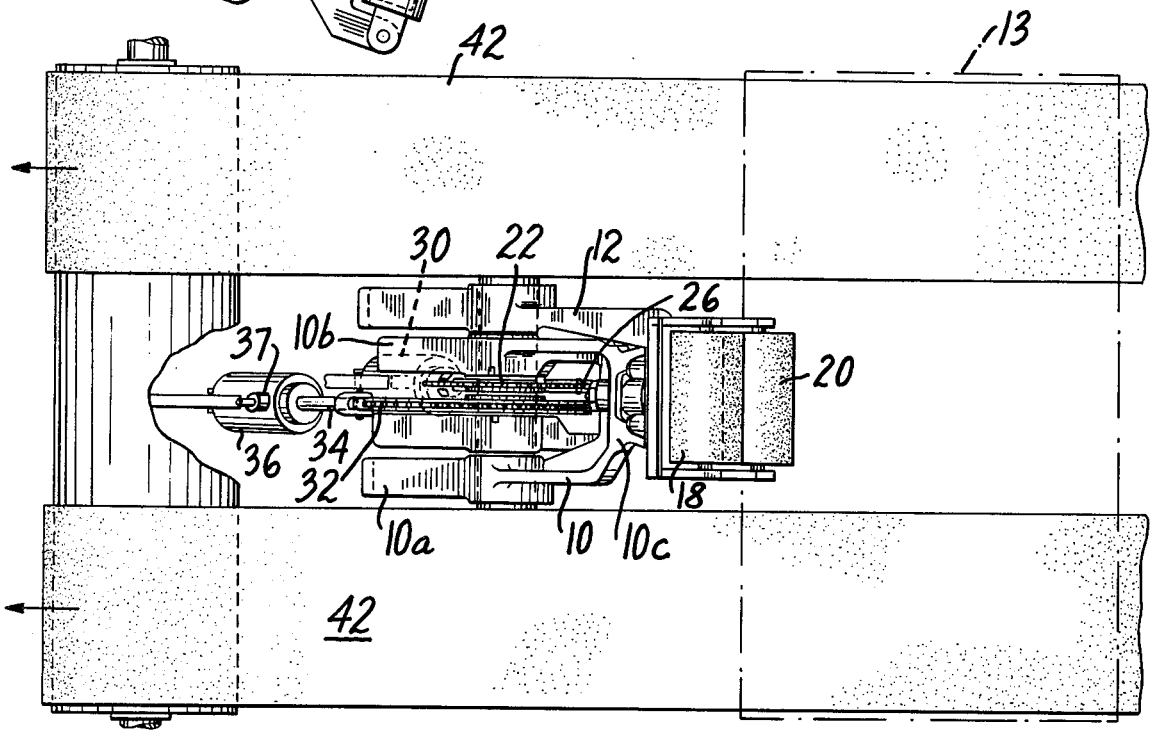
FIG. 2 is a top plan view of the apparatus shown in FIG. 1, depicting more particularly the manner in which the chain connector members which connect the respective cylinder rods with the respective arm sprockets are wound on such sprockets, the winding courses of the two chains being in opposite directions.

With reference to FIGS. 1 and 2 of the drawings, the apparatus of the present invention comprises a pair of arms 10 and 12 mounted on a common pivot 14, although separate pivots disposed on co-directional axes could also be used, it being only necessary that the arms rotate in parallel planes. Carried at the free ends of the arms are the respective wipe down rolls 18 and 20 although as mentioned earlier, other wipe down devices such as shaped shoes could be used in the place of rollers. Associated with the arms 10, 12 are sprocket members 22 and 24 respectively, which sprockets are fixed to their respective arms for rotation therewith and as will be understood to apply a rotative force to the arms when the soon to be described air cylinder units are operated and when a carton 13 to which tape wipe down pressure is to be applied is passed through a taping station of the apparatus. The arms 10, 12, it will be understood, are each two branched structures, the arm 10, e.g., having a branch 10*a* and a branch 10*b* which merge at one end to provide a roller mounting web 10*c*.

Connected to the sprocket 22 of arm 10 is a chain 26 which in turn is connected to the cylinder rod 28 of a fluid pressure actuated cylinder unit 30. In preferred form, the fluid actuation is effected by means of air pressure. Similarly, a chain 32 is wound around sprocket 24 associated with arm 12 and is connected to the rod 34 of a second cylinder unit 36.

When the arms are disposed in an initial carton engaging position as is shown in FIG. 1, the rod 28 of cylinder 30 will be in retracted position and the rod 34 of cylinder 36 will be in extended position. As the carton makes its initial contact with the roller 18, the leading vertical surface 40 of such carton 13 will make such initial contact and the continued horizontal movement of the carton along the conveyor 42 will cause the arm 10 to rotate in a counter-clockwise direction. It will be understood that a tape supply means (not shown) is employed to feed tape intermediate the front vertical, bottom horizontal and rear vertical surfaces of the carton and the respective roller units. Representative of a tape feed operation is U.S. Pat. No. 3,461,020. The wipe down roll 18 at the end of the arm 10 will concurrently start to move up the front leading vertical surface 40 of the carton. Rotation of the arm 10 will through the agency of its chain member 26, cause cylinder rod 28 to extend notwithstanding the presence of any air pressure within the cylinder unit 30 which otherwise would maintain the rod in retracted position. A bypass or relief chamber could in conventional manner be used in conjunction with cylinder 30 to accommodate any air forced therefrom by this rotation of arm 10. The applied tape course is depicted in FIG. 1 at 50 which shows how the tape appears when applied to and wiped down on the carton, such depiction being made as shown to indicate to wipe down courses the rollers 18, 20 follow in effecting wipe down. Hose 33 connected to cylinder 30 connects the latter with a source of air under pressure.

By reason of the engagement of carton 13 with roller 18 and the rotation of arm 10 tended to be resisted by cylinder unit 30, there is produced a wipe down pressure of tape by roller 18 against leading end surface 40 of a predetermined magnitude. As will appear the present invention provides that the wipe down pressures exerted against trading surface 40 is of substantially greater magnitude.

Figure 3B:
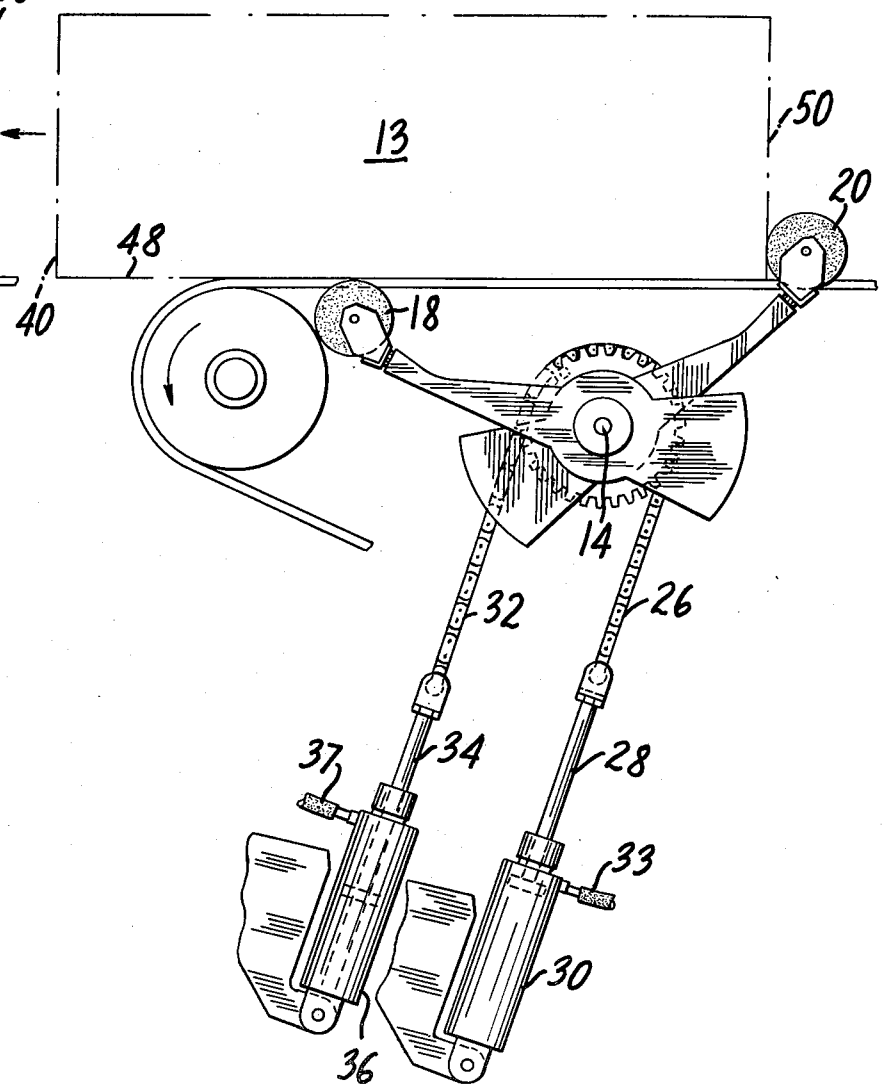
FIGS. 3*a* and 3*b* show, respectively, the positions of the cylinder unit rods at the time when both wipe down rollers are positioned beneath the bottom horizontal surface of the carton, and those of the rods when the second wipe down roll has engaged the trailing vertical surface of the carton and is moving upwardly thereon.
Figure 3A:
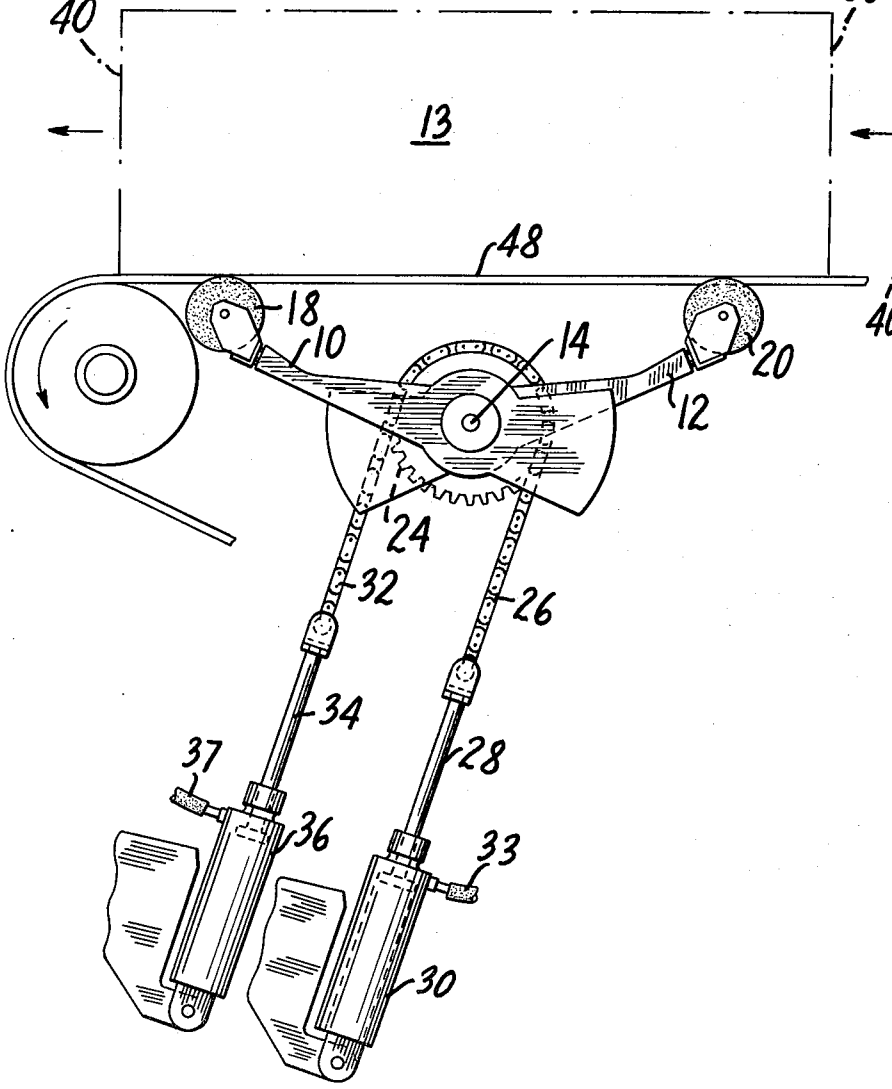

As the carton is continuing its travel along the conveyor, the roller 20 at the tip end of arm 12 will be disposed along the bottom horizontal 48 surface thereof. With continued passage of the carton along the conveyor, and as is shown in FIGS. 3*a* and 3*b*, roller 18 will roll down the front vertical surface and pass to the underside of the carton to an intermediate condition as shown in FIG. 3*a* in which both wipe down rollers will be wiping down tape at the bottom horizontal surface of the carton. While the rollers and arms are in the position shown in FIG. 3*a*, both cylinder rods will be extended, that associated with arm 10 of course, having been extended by rotation counterclockwise of arm 10. However, at a fraction of a second before the second wipe down roller 20 passes from the lower horizontal surface to the rear or trailing vertical surface 50 thereof, roller 20 will start to move up the rear vertical surface of the carton and at the same time pressurized air flow will be admitted to cylinder 36 through hose 37 to start retracting its rod 34. Such point of actuation of cylinder unit 36 could be about 2" before the roller 20 moves onto the carton trailing vertical surface 50. In retracting, the chain 32 will rotate arm 12 in the direction of travel of the carton and cause application to the trailing vertical surface 50 of a positive wipe down pressure of substantial magnitude and greater than that applied by roller 18 to surface 40.

Following the complete passage of the carton beyond the wipe down rollers, the air pressure supplied to cylinder 30 will cause its rod 28 to retract and hence rotate arm 10 in a clockwise direction, the rotation of arm 10 also resulting in its driving engagement with arm 12 and clockwise rotation of such arm 12 since the air pressure in cylinder unit 36 will have now been released and thus the roller members will be returned to an initial carton engaging position as shown in FIG. 1 ready for wiping down of the next carton travelling on the conveyor.

In a preferred form, pistons in each of cylinder units 30, 36 are of substantially equal diameter and so that to effect greater wipe down pressure with roller 20 than roller 18, the magnitude of air pressure supplied to cylinder 36 will be of substantially greater measure than that supplied to air cylinder 30. For example, the pressure in air cylinder 36 could be on the order of 40 psig whereas that supplied to cylinder unit 30 will be on the order of about 20 psig, a ratio of at least 2:1. Higher pressures could be used in cylinder unit 36 if greater wipe down pressure is desired.

Operation of air cylinder 30, it will be seen, is readily controlled as it can be continuously connected with a source of air under pressure and employ in conjunction therewith a relief chamber to accommodate the air present therein when the carton rotates arm 10 counterclockwise. Also suitable venting of the cylinder could be practiced by employing a solenoid operated valve unit. Air cylinder 36 is controlled by a solenoid operated valve. When the carton reaches a position just prior to the point the wipe down roller 20 will pass onto the vertical trailing surface of the carton, a trigger disposed in the path of the carton leading vertical surface could be actuated (such trigger would be similar to the type of trigger 29 disclosed in U.S. Pat. No. 4,028,865) to close a switch completing an electrical circuit to operate a solenoid controlled air valve for admitting high pressure air to cylinder 36. On completing the wipe down operation, a further trigger unit disposed in the path of carton travel could be employed to deenergize the solenoid and hence release the pressure in cylinder 36.

While there is above disclosed but one embodiment of the improved tape wipe down apparatus of the present invention, it will be apparent that various modifications can be made therein without departing from the scope of the inventive concept herein disclosed.

What is claimed is:

1. In apparatus for wiping down adhesive tape which has been applied along at least portions of horizontal and vertical surfaces of a carton travelling on a horizontal conveyor, said apparatus including a cooperative pair of first and second arms swingably mounted for rotation about co-directionally disposed axes, each arm carrying at its free end tape wipe down means, the swinging arms in an initial carton engaging position thereof being in closed together configuration and presenting one of said wipe down means for engagement with a carton leading vertical surface and the other wipe down means for engagement with said horizontal carton surface, horizontal movement of said carton while in engagement with both wipe down means spreading said arms apart for maintaining said one wipe down means initially in contact with said leading vertical surface of said carton and then a horizontal surface thereof, and said second wipe down means initially in contact with said carton horizontal surface and then a trailing vertical surface thereof, there being first force applying means operatively connected with the arm carrying said one wipe down means tending to rotate said arm counterdirectional to rotation imparted thereto by movement of said carton whereby a wipe down pressure of a predetermined magnitude is applied to the tape on said leading vertical surface by said one wipe down means, the improvement of second force applying means operatively connected with the arm carrying said second wipe down means tending to rotate said arm in the direction of travel of said carton with a force sufficient to cause said second wipe down means to apply a wipe down pressure to the tape on said trailing vertical surface which is of substantially greater magnitude than that applied to the tape on said leading vertical surface by said one wipe down means, said arms being in driving relation with one another when they are in said closed together configuration, said first force applying means being continuously operative, said second force applying means being temporarily disabled upon disengagement of said arms from a carton to permit restoration of both of said arms to said initial carton engaging position by said first force applying means.

2. The apparatus of claim 1 in which said first and second force applying means are pneumatically actuated cylinder units.

3. The apparatus of claim 1 wherein each cylinder unit includes a cylinder rod, the rod of the cylinder unit associated with the arm carrying said one wipe down means being in retracted position and the rod associated with the arm carrying said second wipe down means being in extended position when said pair of arms are in initial carton engaging position, the rotation by carton movement of the arm carrying said one wipe down means causing the rod of the cylinder unit associated therewith to move to extended position, said last-mentioned cylinder unit having means for admitting pressurized fluid flow thereto tending to prevent extension of said rod, the cylinder unit associated with the arm carrying said second wipe down means having means for admitting pressurized fluid flow thereto to cause retraction of the rod of said cylinder unit when said second wipe down means is engaged with the carton trailing vertical surface.

4. The apparatus of claim 3 in which each arm has a drive wheel fixed thereto, and a connector drive element connecting said drive wheel with the rod of the associated cylinder unit.

5. The apparatus of claim 4 in which the drive wheel is a sprocket member and the connector drive element is a chain engaged on said sprocket.

6. The apparatus of claim 3 in which the respective cylinder units have pistons connected to the associated cylinder rod, said pistons being of equal diameter, the pressurized fluid flow admitted to the cylinder unit associated with the arm carrying said second wipe down means being of substantially greater magnitude than that admitted to the other cylinder unit.

7. The apparatus of claim 6 in which the pressurized fluid flow admitted to the cylinder unit associated with the arm carrying said second wipe down means is at least twice that admitted to the other cylinder unit.

8. The apparatus of claim 3 in which said wipe down means are rotary rollers.

9. The apparatus of claim 1 in which said first and second force applying means are fluid actuated cylinder units.

* * * * *